US005322553A

United States Patent [19]

Mandich et al.

[11] Patent Number: 5,322,553

[45] Date of Patent: Jun. 21, 1994

[54] ELECTROLESS SILVER PLATING COMPOSITION

[75] Inventors: Nenad V. Mandich, Homewood, Ill.; Gerald A. Krulik, El Toro; Rajwant Singh, Fullerton, both of Calif.

[73] Assignee: Applied Electroless Concepts, Lake Forest, Calif.

[21] Appl. No.: 20,618

[22] Filed: Feb. 22, 1993

[51] Int. Cl.[5] ..... C23C 18/31; B05D 1/18; B32B 15/00

[52] U.S. Cl. ..... 106/1.23; 106/1.26; 427/437; 428/680

[58] Field of Search ..... 106/1.23, 1.26; 427/437; 428/680

[56] References Cited

U.S. PATENT DOCUMENTS 4,798,626 1/1989 Perovetz et al. ..... 106/1.23
4,925,491 5/1990 Perovetz et al. ..... 106/1.23

*Primary Examiner*—Helene Klemanski

[57] ABSTRACT

An electroless silver plating solution comprises a silver(I) complex, a thiosulfate salt, and a sulfite salt. This electroless silver plating solution uses a novel reducing agent combination of thiosulfate and sulfite. It shows a plating rate and a plating solution stability far superior to those of conventional silver plating solutions containing formaldehyde, reducing sugars, borohydride, hydrazine, and other reducing agents.

21 Claims, No Drawings

ELECTROLESS SILVER PLATING COMPOSITION

BACKGROUND OF THE INVENTION

The present invention relates to an electroless silver plating solution, and more particularly, to a silver plating solution which uses a novel reducing agent system which is low in toxicity and very stable.

Many types of reducing agents have previously been suggested. These have included sodium hypophosphite, hydrazine, reducing sugars, glyoxal, thiourea, sodium borohydride, formaldehyde, sodium thiosulfate, monomethylamine borane, dimethylamine borane, and others. None of these baths are truly stable or commercially useful on a large scale. Most have very short effective plating lives, often in the range of hours or a few days. The solution, once made, will spontaneously and rapidly plate all surfaces with which it is in contact, including the container (Pearlstein and Weightman, Plating, 61, 154–7).

Most of the presently known commercial electroless silver plating solutions contain ammonia either as a stabilizer, a main complexing agent, or both. This is known to result in a major problem, as silver-amine complexes are known to be very shock sensitive explosives when dried. Explosions have occurred even when a glass stir rod is lifted from against the side of a beaker, disturbing the dried film.

Electroless silver plating solutions are generally considered to be borderline catalytic electroless metals (Cheng, et al, Plating and Surface Finishing, 77,130–132 (1990). True electroless metals such as copper and nickel can continuously build total metal thickness to indefinitely thick coatings of 25 microns (0.001 inch) or more. The freshly deposited metal is fully catalytic and remains capable of initiating further electroless metal deposition. Electroless silver baths, by contrast, rapidly lose autocatalytic activity. The freshly deposited silver metal is rarely able to continue catalytic activity beyond 0.25 microns (0.000010 inch).

SUMMARY OF THE INVENTION

An object of the present invention is to provide an electroless silver plating solution which uses a novel reducing agent system. This system comprises the redox system thiosulfate-sulfite-sulfate. No other reducing agent is needed. The need for any additional type of reducing agent, such as reducing sugars, formaldehyde, hydrazine, or boron hydrides, has been eliminated. The bath does not contain ammonia or cyanide ions as a plating constituent, and has a plating rate and a plating solution stability far greater than previously known electroless silver baths. The bath is a true electroless silver plating bath, not an immersion bath, since the silver thickness continues to increase with time in a fashion typical of electroless nickel and electroless copper baths.

The electroless silver plating solution according to the present invention may be prepared from any convenient cyanide-free, soluble silver solution or silver(I) salt. Silver nitrate or other compounds containing oxidizing agents are not desirable as they may react with the bath constituents. Suitable silver sources are silver oxide, silver sulfate, silver chloride, silver bromide and silver sulfite. The silver(X) sulfite may be prepared from sulfite, bisulfite, or metabisulfite salts by known procedures. Alternatively, the soluble silver source may be a silver thiosulfate complex. Ammonia may be used to help solubilize the silver salt; while this does not destroy the plating ability of the bath, it could cause explosion problems due to silver amine formation so it is undesirable. Regardless of the exact silver source used initially, the final electroless plating solution will contain a mixture of both silver thiosulfate and silver sulfite complexes.

The above-mentioned object can be attained by providing an electroless silver plating solution which comprises water, a silver complex, a thiosulfate, a sulfite, a pH regulator, and optionally an oxidation rate controller. The solution seems to work in the following manner. The initial silver complex is dissolved and stabilized by the addition of sulfite or metabisulfite.

Sulfite solutions oxidize readily to sulfate in the presence of air or other mild oxidizing agents. Contaminants such as copper or nickel ions increase the rate of oxidation of sulfite, and thus decrease the bath stability. An optional oxidation rate controller can be used to reduce the effect of such contaminants. Useful oxidation rate controllers include organic chelating agents such as the sodium salts of strong chelating agents such as EDTA (ethylenediaminetetraacetic acid) and NTA (nitrilotriacetic acid). However, the incorporation of an oxidation rate controller alone into a silver sulfite bath does not make the bath stable, nor does it make the bath an electroless plating bath.

It has been discovered that the addition of another sulfur compound, a thiosulfate, dramatically changes the character and stability of a sulfite silver solution. When controlled at the proper temperature and pH, the solution becomes an effective electroless silver plating bath which gives useful plating rates over an indefinite period. This electroless silver bath has a long bath life under heavy use conditions, with many complete silver replenishment cycles. The plating rate can be varied over a wide range without drastically affecting the stability.

While not wishing to be bound by theory, the process is hypothesized to work due to the mutually interactive effects of the sulfite and thiosulfate. Sulfite and thiosulfate can interconvert freely to each other under the proper conditions. The thiosulfate may increase the stability of the initial silver sulfite complex by also forming silver thiosulfate complexes. The thiosulfate may also function as an effective sink and source for sulfite, which is thought to be the main reducing agent. As previously stated, baths containing only sulfite are very unstable and are not effective electroless plating solutions. Baths containing only thiosulfate are stable but are not effective electroless plating solutions. Electroless silver baths containing both a sulfite salt and a thiosulfate salt show electroless plating behavior and high bath stability without the use of any additional reducing agents. This stability is enhanced by use of the optional oxidation rate controllers and operation at controlled pH and temperature.

The following paragraphs (a) to (e) describe the amounts of the constituents of the electroless silver plating solution according to the present invention:

(a) A suitable content of the silver as silver(I) complexes is from 0.5 to 100 grams of silver per liter and preferably from 1.5 to 15 g/l. If the concentration of the silver is too low, the plating reaction is very slow. If the silver concentration is too high, it is difficult to control the plating rate and uncontrolled plating may occur on the container and unwanted areas of the plating surface.

(b) The total amount of thiosulfate used in the bath may vary from about 1 g/l to saturation at operating temperature. A preferred range is from about 10 to about 475 g/l, and the most preferred range is from about 15 g/l to about 200 g/l.

(c) The content of sulfite in the bath may vary from about 0.01 g/l to about 200 g/l at operating temperature. A preferred range is from about 0.3 to about 60 g/l, and the most preferred range is from about 1 to about 20 g/l.

(d) If present, the optional oxidation rate controller used in the bath may vary from about 0.001 g/l to about 50 g/l. The most preferred range is from about 0.1 g/l to about 10 g/l.

(e) The pH value of the plating solution is from 7–11, preferably from 7.5–9. The solution operating temperature may be from 35 to 95 degrees C (95°–205° F.), and most preferably from 55 to 75 degrees C (130° F.–165° F.).

(f) The preferred range of ratios of thiosulfate salt to silver is between 1.66/1 and 66.6/1. A more preferred range is 2/1 to 50/1. The preferred range of ratios of thiosulfate salt to sulfite salt is between 1/1 and 200/1. A more preferred range is 1/1 to 200/1.

(g) The preferred range of compositions for the electroless silver plating solution comprises 0.005 to 1 mole per liter of silver as silver (I) complex; 0.01 to 3 moles per liter of a thiosulfate salt; and 0.001 to 0.5 moles per liter of a sulfite salt.

DETAILED DESCRIPTION OF THE PREFERRED EMBODIMENTS

The present invention will be described in more detail in the following examples. These examples are intended to be illustrative of the invention and not limiting the invention. The electroless silver compositions of the present invention will not plate directly upon copper, the copper being rapidly dissolved without allowing a silver layer to form. Electroless silver will plate directly upon electroless nickel and electrolytic nickel, so all test pieces were copper clad printed circuit boards coated with electroless nickel. The silver bath of the present invention is a true electroless bath. Many so-called electroless baths are merely immersion baths which function by dissolving the pre-existing surface and replacing it with another metal from solution. All previously known electroless silver plating compositions are poorly autocatalytic and give only a thin silver film of less than 0.25 micron. A true electroless bath will plate on a continuous surface of a support metal which does not dissolve in the bath, for example an electroless or electrolytic nickel layer, to give a thick deposit.

Although the disclosure hereof is detailed and exact, the formulations listed in the examples are merely illustrative of useful plating bath formulations. Any formulator skilled in the art can utilize these examples and this concept to prepare many workable solutions in addition to those shown in the examples.

EXAMPLES 1–8

Test articles were one ounce per square foot copper foil clad epoxy glass laminate printed circuit board material. These boards were cut into 2.5 cm by 7.5 cm sections for convenience of use. The test boards were prepared for electroless silver plating tests by coating them with a medium phosphorous (6–9 ) electroless nickel. Any effective preparation cycle and electroless nickel are suitable. The boards were cleaned, catalyzed with a palladium chloride/hydrochloric acid solution, and plated in a standard electroless nickel to 0.2 mils (5 microns) thickness.

EXAMPLE 1

The electroless silver plating composition consisted of a solution of 200 g/l sodium thiosulfate, 20 g/l of sodium sulfite, and 3 g/l of silver as a silver(X) complex. No strong chelating agent was used. The pH was adjusted with potassium carbonate solution to pH 7.5 and the solution heated to 65° C. The silver thickness was 62 millionths of an inch after 15 minutes. The appearance was dull grey. The bath showed no plateout or other instability.

EXAMPLE 2

The electroless silver plating composition consisted of a solution of 200 g/l sodium thiosulfate, 1 g/l of sodium sulfite, 0.1 g/l of disodium EDTA, and 3 g/l of silver as a silver(I) complex. The pH was adjusted to pH 7.5 and the solution heated to 65° C. The silver thickness was 44 millionths of an inch after 15 minutes. The appearance was dull grey. The bath showed no plateout or other instability.

EXAMPLE 3

The electroless silver plating composition consisted of a solution of 10 g/l sodium thiosulfate, 2 g/l of sodium sulfite, 0.1 g/l of disodium EDTA, and 3 g/l of silver as a silver(I) complex. The pH was adjusted to pH 8.5 and the solution heated to 80° C. The silver deposit was white and non-uniform, so thickness could not be measured. The bath showed no plateout or other instability.

EXAMPLE 4

The electroless silver plating composition consisted of a solution of 5 g/l sodium thiosulfate, 50 g/l of sodium sulfite, 0.1 g/l disodium EDTA, and 3 g/l of silver as a silver(I) complex. The pH was adjusted to pH 8.0 and the solution heated to 50° C. The silver deposit was white and non-uniform, so thickness could not be measured. The bath showed no plateout or other instability.

EXAMPLE 5

The electroless silver plating composition consisted of a solution of 20 g/l sodium thiosulfate, 20 g/l of sodium sulfite, 0.1 g/l disodium EDTA, and 6 g/l of silver as a silver(I) complex. The pH was adjusted to pH 8.5 and the solution heated to 60° C. The silver thickness was 2.2 millionths of an inch after 15 minutes. The silver deposit was white and non-uniform, so thickness could not be measured. The bath showed no plateout or other instability.

EXAMPLE 6

The electroless silver plating composition consisted of a solution of 100 g/l sodium thiosulfate, 5 g/l of sodium sulfite, 0.1 g/l disodium EDTA, and 10 g/l of silver as a silver(I) complex. The pH was adjusted to pH 8.0 and the solution heated to 40° C. The white silver deposit was non-uniform, so thickness could not be measured. The bath showed no plateout or other instability.

EXAMPLE 7

The electroless silver plating composition consisted of a solution of 10 g/l sodium thiosulfate, 0.2 g/l of sodium sulfite, 0.1 g/l disodium EDTA, and 3 g/l of silver as a silver(I) complex. The pH was adjusted to pH 7.5 and the solution heated to 60° C. The silver deposit was dull white and thickness was about 20 millionths of an inch after 15 minutes. The bath showed no plateout or other instability.

EXAMPLE 8

The electroless silver plating composition consisted of a solution of 10 g/l sodium thiosulfate, 0.2 g/l of sodium sulfite, and 3 g/l of silver as a silver(I) complex. No strong chelating agent was used. The pH was adjusted to pH 7.5 and the solution heated to 60° C. The silver deposit was white and thickness was about 20 millionths of an inch after 15 minutes. The bath showed no plateout or other instability.

What is claimed is:

1. An electroless silver plating solution comprising water, a noncyanide silver(I) complex, a thiosulfate salt, and a sulfite salt.

2. An electroless silver plating solution according to claim 1, which additionally contains an oxidation rate controller.

3. An electroless silver plating solution according to claim 1, wherein said noncyanide silver (I) complex comprises a silver sulfite, a silver thiosulfate, or a mixture of both.

4. An electroless silver plating solution according to claim 1, wherein the concentration of silver is between 0.5 and 100 g/l.

5. An electroless silver plating solution according to claim 4, wherein the concentration of silver is between 1.5 and 15 g/l.

6. An electroless silver plating solution according to claim 1, wherein the ratio of thiosulfate salt to silver is from 1.66/1 to 66.6/1.

7. An electroless silver plating solution according to claim 6, wherein the ratio of thiosulfate salt to silver is from 2/1 to 50/1.

8. An electroless silver plating solution according to claim 1, wherein the ratio of thiosulfate salt to sulfite salt is from 0.1/1 to 200/1.

9. An electroless silver plating solution according to claim 8, wherein the ratio of thiosulfate salt to sulfite salt is from 1/1 to 200/1.

10. An electroless silver plating solution according to claim 1, said solution having a pH of 7 to 11.0.

11. An electroless silver plating solution according to claim 1, wherein the content of silver(I) complex is 0.005 to 1 moles per liter, the content of the thiosulfate salt is 0.01 to 3 moles per liter, and the content of the sulfite salt is 0. 001 to 0.5 moles per liter.

12. An electroless silver plating solution according to claim 2, wherein said oxidation rate controller is an organic chelating agent.

13. The electroless silver plating solution of claim 12 wherein the chelating agent is a sodium salt of EDTA or NTA.

14. A method of depositing silver on a surface of an article by electroless deposition which comprises immersing said surface in the solution of claim 1 at a temperature between about 35° and 95° C. and a pH between 7 and 11 for a time sufficient to deposit silver on said surface.

15. The method of claim 14 wherein the surface is nickel.

16. The method of claim 14 wherein the surface is a metal which does not dissolve in said solution.

17. An article produced by the method of claim 14.

18. The electroless silver plating solution according to claim 1 wherein the concentration of thiosulfate is from 1 g/l up to saturation.

19. The electroless silver plating solution according to claim 8 wherein the concentration of thiosulfate is between 15 and 200 g/l.

20. The electroless silver plating solution according to claim 1 wherein the concentration of sulfite is between 0.01 g/l and 200 g/l.

21. The electroless plating solution of claim 20 wherein the concentration of sulfite is between 1 and 20 g/l.

* * * * *